US005182431A

United States Patent [19]

Koontz et al.

[11] Patent Number: 5,182,431

[45] Date of Patent: Jan. 26, 1993

[54] ELECTRICALLY HEATED WINDOW

[75] Inventors: Harry S. Koontz, Pittsburgh; John P. Forr, Altoona, both of Pa.

[73] Assignee: PPG Industries, Inc., Pittsburgh, Pa.

[21] Appl. No.: 809,113

[22] Filed: Dec. 18, 1991

[51] Int. Cl.[5] ..... H05B 3/06

[52] U.S. Cl. ..... 219/203; 219/547; 219/522; 219/543

[58] Field of Search ..... 219/547, 522, 543, 203; 338/306-314; 296/84.1

[56] References Cited

U.S. PATENT DOCUMENTS 3,623,906 11/1971 Akeyoshi ..... 219/203
3,792,232 2/1974 Zarenko ..... 219/522
3,982,092 9/1976 Marriott ..... 219/203
4,513,196 4/1985 Bartelsen et al. ..... 219/203
4,725,710 2/1988 Ramus et al. ..... 219/203

FOREIGN PATENT DOCUMENTS 1300115 12/1972 United Kingdom .

*Primary Examiner*—Bruce A. Reynolds
*Assistant Examiner*—Michael O. Switzer
*Attorney, Agent, or Firm*—Andrew C. Siminerio

[57] ABSTRACT

An electrical resistance heated window having at least three heatable zones and at least one of the heatable zones is generally centrally located on the window and can be heated faster to a higher temperature than the other of the zones for faster defogging and deicing of that particular zone.

13 Claims, 1 Drawing Sheet

ELECTRICALLY HEATED WINDOW

FIELD OF THE INVENTION

The present invention relates to electrical resistance heated windows having at least three heatable zones and at least one of the heatable zones is generally centrally located on the window and can be heated faster to a higher temperature than the other of said zones for faster defogging and deicing of that particular zone.

BACKGROUND OF THE INVENTION

Windows and particularly vehicle windows are frequently provided with self defogging and deicing capabilities by the surface application of electrical resistance elements. These electrical resistance elements are typically applied to the interior surface of the rear window of an vehicle such as an automobile, van, truck or the like and are sometimes referred to as backlight heaters. There are also applications for this technology in the marine and aircraft fields While this approach of defogging and deicing vehicle windows has been quite satisfactory, there continues to be a need to reduce the response time of the type of electrical resistance elements particularly in the zones of the window which are vision critical.

Another pressing need in this general area is to accommodate larger rear windows in terms of providing the necessary defogging and deicing capabilities with the efficient use of materials involved in the application of the electrical resistance elements and their bus bars, all of which include a high silver content. In addition, in light of a vehicle's limited ability to provide additional power to such an application, it is important not to waste any of the available power.

A considerable amount of material is typically used in providing the power supply electrical connection points as may be specified by the vehicle manufacturer. High volume manufacturing techniques employed in the assembly of automobiles, vans and the like, dictate that both of the electrical connection points of the electrical resistance element defogging and deicing system be close together for efficient connection to the vehicle power supply system. Typically, the prior art electrical resistance element defogging and deicing systems require the use of extended length bus bars, braided elements and the like to accomplish the necessary proximity of the electrical connection points. These extended length elements not only require the excessive use of high silver content materials but also introduce an unwanted high voltage drop element into the heating system. The use of braided elements, to reduce the unwanted high voltage drop, also involves the additional expensive step of soldering to connect it to the heating system.

Windows of this type are one of many new electrical and electronic components and systems being used in vehicles which makes it all the more important that each such component and system, including electrical resistance element defogging and deicing systems, optimize the power consumption for its given task.

SUMMARY OF THE INVENTION

It is, therefore, an important object of the present invention is to provide an electrically heated window wherein both of the electrical connection points of the electrical resistance element defogging and deicing system applied thereto are close together for efficient connection to its associated power supply system.

Another important object of the present invention is to provide an electrically heated window including an electrical heating system which is inexpensive to manufacture and may be readily applied to differently formed, sized and shaped windows.

Another important object of the present invention is to provide an electrically heated window including an electrical heating system which optimizes its electrical consumption to effectively and efficiently remove any ice or condensation which may have formed on the window in the vision critical areas.

Yet another important object of the present invention is to provide an electrically heated window including an electrical heating system, the electrical heating system comprising at least three electrical resistance heating elements connected in series, each of the electrical resistance heating elements having bus bars and a plurality of electrically conducting resistive filaments connected therebetween to generally define at least three heatable zones wherein at least one of the heatable zones being centrally positioned with respect to the other of the heatable zones, a first power supply connecting means connectable to one of the electrical resistance heating elements and a second power supply connecting means connectable to another of the electrical resistance heating elements. The electrical resistance heating elements, their respective electrically conducting resistive filaments and the interconnecting bus bars are configured to provide a highly efficient heating system geometry for a window heating system to produce a higher temperature generally in the centrally positioned heatable zones at a more rapid heating rate than the temperature and heating rate in the other of the heatable zones.

Other objects and advantages will become more apparent during the course of the following description when taken in connection with the accompanying drawing.

DETAILED DESCRIPTION OF THE INVENTION

Figure 1:
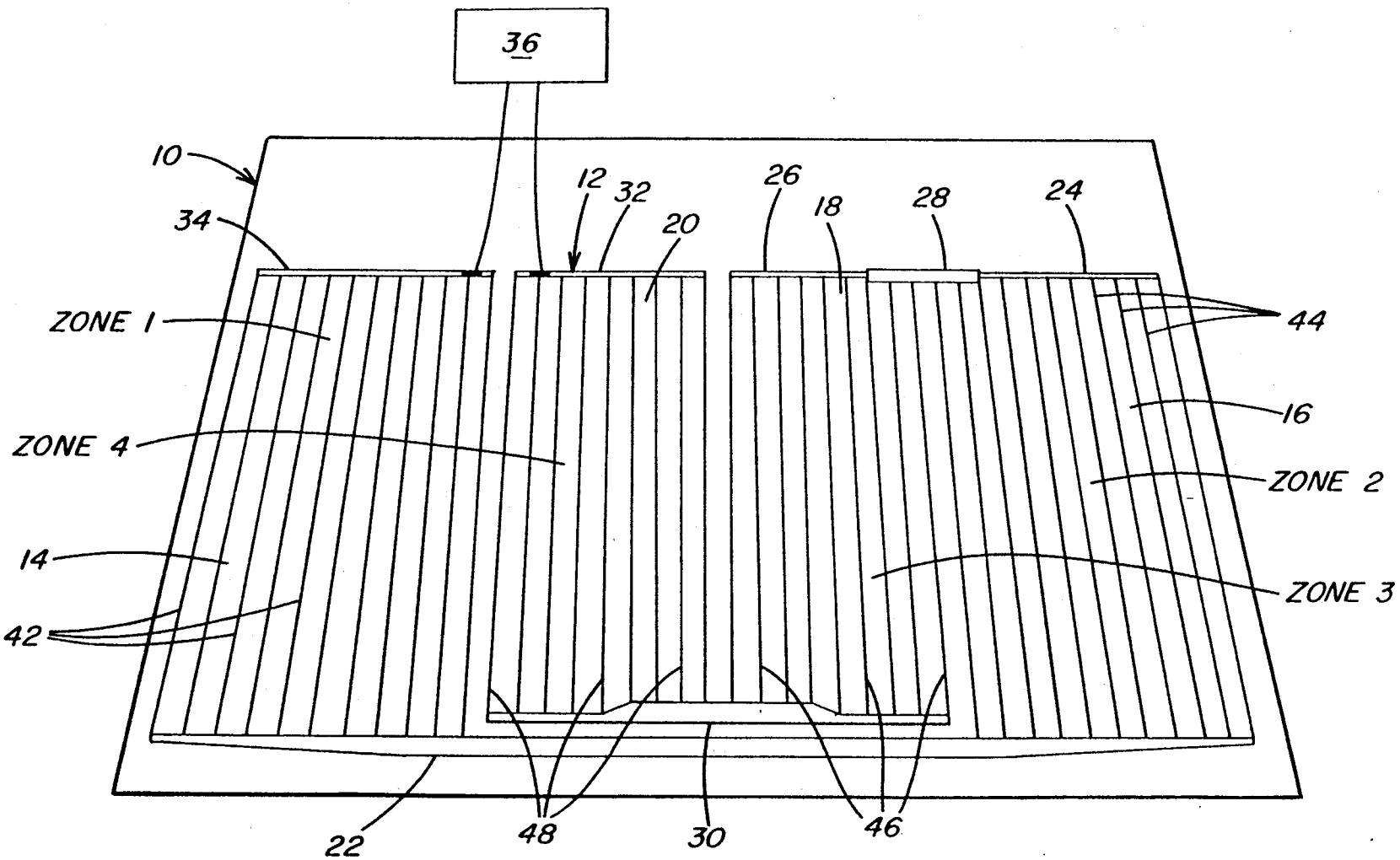
FIG. 1 is a plan view of an electrically heated vehicle window embodying the present invention.

As seen in FIG. 1, an electrically heated window 10 is provided with an electrical heating system 12 in accordance with the present invention. The window, which is generally trapezoidal in shape, may typically be a monolithic or laminated composite window structure as used in automotive, van and truck applications. The window shape and structure may of course vary depending upon the specific application involved. Further, the heating system 12 of the present invention may be applied to marine and aircraft window structures as well.

The electrical heating system of FIG. 1 has four electrical resistance heating elements connected in series. A first electrical resistance heating element 14 is connected to a second electrical resistance heating element 16 and the second electrical resistance heating element 16 is connected to the third electrical resistance heating element 18 and the third electrical resistance heating element 18 is connected to the fourth electrical resistance heating element 20.

Each of the electrical resistance heating elements 14, 16, 18 and 20 have bus bars and a plurality of electrically conducting resistive filaments connected therebetween to generally define at least four heatable zones. More particularly, the first and second electrical resistance heating elements 14 and 16 are electrically interconnected by a lower bus bar 22 which, in the particular embodiment of the invention illustrated in FIG. 1, traverses substantially the entire length of the window 10.

The upper bus bar 24 of the second electrical resistance heating element 16 is electrically interconnected to the upper bus bar 26 of the third electrical resistance heating element 18 by a electrical coupling device such as a braided jumper 28. The braided jumper 28 may be a soldered covered braid 0.25 inch wide by 0.0625 inch thick (0.64 cm by 0.16 cm). The braided jumper 28 provides a low resistance path and generates very little heat.

The third electrical resistance heating element 18 and the fourth electrical resistance heating element 20 are electrically interconnected by a lower bus bar 30 which is positioned on the window 10 above the bus bar 22 connecting the first electrical resistance heating elements 14 and second electrical resistance heating element 16 and, in the particular embodiment shown in FIG. 1, generally parallel thereto.

Upper bus bar 32 of the fourth electrical resistance heating element 20 and upper bus bar 34 of the first electrical resistance heating element 14 serve as the connection platform for connecting the heating system 12 to the vehicle power supply 36. Suitable connectors 38 and 40, such as but not limited to male "blade" type connectors as are well known in the art, may be soldered to the bus bars 32 and 34 for suitable connection to the external power supply 36 by complimentary female type connectors as typically used in automotive electrical component connection applications.

Electrically conducting resistive filaments 42 are connected between bus bars 34 and 22 of the first electrical resistance heating element 14. Electrically conducting resistive filaments 44 are connected between bus bars 22 and 24 of the second electrical resistance heating element 16. Electrically conducting resistive filaments 46 are connected between bus bars 26 and 30 of the third electrical resistance heating element 18. Electrically conducting resistive filaments 48 are connected between bus bars 30 and 32 of the fourth electrical resistance heating element 20. Electrically conducting resistive filaments 46 and 48 of the third and fourth electrical resistance heating elements 18 and 20, respectively, are less in number than the electrically conducting resistive filaments 42 and 44 of the first and second electrical resistance heating elements 14 and 16 for a purpose to be later discussed.

Although not limiting in the present invention, in the particular embodiment illustrated in FIG. 1, the upper bus bars 34, 24, 26 and 32 of the electrical resistance heating elements 14, 16, 18 and 20, respectively, are all positioned generally horizontally and in-line on the window 10, bus bar 30 is generally parallel to bus bar 22 and all of the corresponding electrically conducting resistive filaments 42, 44, 46 and 48 are positioned at varying angles with respect to their respective bus bars to accommodate differently shaped windows. The relative positions of the bus bars and the electrically conducting resistive filaments will, of course, change with the shape and dimension of the window to which the heating system 12 of the present invention is applied.

Although not limiting in the present invention, in the embodiment illustrated in FIG. 1, the first electrical resistance heating element 14 generally defines a first outer heatable zone generally at one end of the window 10 and is denoted as Zone 1. The second electrical resistance heating element 16 generally defines a second outer heatable zone generally at the other end of the of the window 10 and is denoted as Zone 2. The third electrical resistance heating element 18 generally defines a third central heatable zone generally adjacent to and inboard on the window 10 of the Zone 2 and is denoted as Zone 3. The fourth electrical resistance heating element 20 generally defines a fourth central heatable zone generally adjacent to and inboard on the window 10 of Zone 1 and generally adjacent to Zone 3 and is denoted as Zone 4.

The heating system 12 may be applied to the window 10 by well known screen printing techniques. Typically, the entire pattern of the system 12 is printed on the window 10 while in a flat unheated state. The material used for forming the pattern of the system 12 is preferably a conductive silver ceramic paste having a silver content of about 65% to 84% and typically about 70%. Once the heating system pattern and any non-electroconductive decorative band has been printed, the flat window is heated in a suitable and well known heating device to fuse the ceramic paste to the surface of the window 10, which typically is done at about 1200° F. (649° C.). The heated glass is then removed from the heating device and either pressed to the final shape or cooled for subsequent processing. When the glass window cools, the pattern becomes a hard ceramic conductive pattern.

Connectors 38 and 40 are secured to the bus bars 32 and 34 and the braided jumper 28 is connected between the upper bus bar 24 of the second electrical resistance heating element 16 and the upper bus bar 26 of the third electrical resistance heating element 18 in any convenient manner, e.g. soldering.

Although not limiting in the present invention, in one particular embodiment the width of the filaments 42, 44, 46 and 48 are in the range of about 0.018–0.042 inches (0.046–0.107 cm) and typically about 0.028 inches and have a thickness of about 0.0003–0.0005 inches (0.0076–0.0127 mm) after heating. In the particular embodiment illustrated in FIG. 1, there are eleven filaments 42 and 44 in Zones 1 and 2, respectively, and nine filaments 46 and 48 in Zones 3 and 4, respectively. The bus bars 22, 24, 26, 30, 32 and 34 have the same thickness as the filaments 42, 44, 46 and 48 and have widths ranging from about 0.50–1.00 inch (1.27–2.54 cm). The width of the bus bars may be varied in relation to the amount of current being carried to prevent the bus bar from overheating. More particularly, for example, the width of the left hand portion of bus bar 22 increases as successive filaments 42 deliver additional current to the bus bar 22 as the current flows from left to right in FIG. 1. Similarly, the width of the right hand portion of bus bar 22 decreases as successive filaments 44 divert current from bus bar 22 as the current flows left to right. It should be appreciated that, if desired, the bus bar width may be maintained at a constant dimension; however space and cost considerations may require changing the bus bar width as discussed above in order to provide an optimal design in terms of performance and cost.

It should be appreciated by one skilled in the art that the lower bus bar 22 may be configured in a manner similar to upper bus bars 24 and 26 and braid 28. More particularly, the left and right hand portions of bus bar 22 may be used as part of the heating circuit in Zones 1 and 2, respectively, and an electrical coupling device, e.g. a braided jumper similar to jumper 28 may be used to electrically interconnect the bus bars. This configuration may also be used in place of single bus bar 30.

It should similarly be appreciated that bus bars 24 and 26 and jumper 28 may be replaced with a single bus bar to electrically interconnect Zones 2 and 3 in a manner similar to the manner that lower bus bar 22 electrically interconnects Zones 1 and 2. Furthermore, the width of bus bars 24 and 26, as well as bus bars 32 and 34, may be varied to account for the increase and decrease in the amount of current flowing therethrough.

While the heating system 12 as above described discloses the application of a silver containing ceramic paste to the interiorly facing surface of a monolithic window 10, the teachings of the present invention are applicable to the surface of a laminated window structure of the types well known in the art. Furthermore, the teachings of the present invention are applicable to a heating system incorporated into the interlayer of a laminated structure. More specifically, in such an application, the heating system 12 may be, at least in part, in the form of fine wires embedded in the thermo-plastic interlayer of the laminated window structure. The wires may typically be of tungsten or tungsten alloy wire having a diameter of 0.0005–0.00065 inches (0.0127–0.0165 mm); or molybdenum or molybdenum alloy wire having a diameter of 0.0007–0.003 inches (0.0178–0.0762 mm); or copper or copper alloy wire having a diameter of 0.0008–0.0012 inches (0.0203–0.0305 cm).

The heating system 12 of the instant invention provides a number of very important advances over the prior art resistance type heating systems both in terms of system function and manufacturing application.

With respect to the former, the heating system 12 is configured to strategically place the resistance heating filaments 46 and 48 at the vision critical centrally positioned Zones 3 and 4. Because there are fewer heating filaments in Zones 3 and 4 through which the current passes as compared to Zones 1 and 2, there is more current passing through each heating filaments 46 and 48 in Zones 3 and 4 as compared to the current passing through filaments 42 and 44 in Zones 1 and 2, respectively. This in turn produces a higher temperature generally in Zones 3 and 4 at a more rapid heating rate than the temperature and heating rate in Zones 1 and 2. This unique zonal heating of the window 10 by the heating system 12 provides for the necessary rapid defogging/deicing capability in the vision critical Zones 3 and 4 and still provides more than ample defogging/deicing capability in the outer Zones 1 and 2 of the window.

With respect to the latter, the heating system 12 strategically places the connectors 38 and 40 to the external power supply (not shown) in close proximity to each other on bus bars 34 and 32, respectively. This important feature allows for quick and efficient electrical connection of the heating system 12 to the external power supply at one location on the window 10. The connection points are typically specified by the vehicle manufacturer and the heating system 12 of the present invention can be readily adapted to provide connection points at several locations on a given window without the necessity of running an expensive and energy consuming extended length bus bar to that location. The heating system 12 also allows for the central "nesting" of Zones 3 and 4 between Zones 1 and 2 and this is achieved, in part, by shorter length of the resistive heating filaments 46 and 48 with respect to the length of the resistive heating filaments 42 and 44.

As an alternative to reducing the number of filaments in Zones 3 and 4, the cross-sectional area of filaments 46 and 48 can be reduced as compared to the cross-sectional area of filaments 42 and 44 in Zones 1 and 2, respectively. By reducing filament cross-sectional area, the relative power in each filament 46 and 48 as compared to filaments 42 and 44 is greater. This in turn produces a higher temperature in Zones 3 and 4 at a more rapid heating rate as compared to the temperature and rate in Zones 1 and 2.

It should be appreciated that the filament number and cross-sectional area may both be changed in a single embodiment of the invention to produce the desired zonal heating results.

It is to be understood that the form of the invention herewith shown and described is to be taken as an illustrative embodiment only of the same, and that various changes in the shape, size, arrangement and composition of the various parts may be resorted to without departing from the spirit of the invention.

We claim:

1. An electrically heated window comprising four electrical resistance heating elements, each of said heating elements having an upper and lower bus bar positioned along top and bottom edge portions of said window and a plurality of electrically conducting resistive filaments extending therebetween, wherein a first heating element generally defines a first outer heatable zone generally at one end of said window, a second heating element generally defines a second outer heatable zone generally at the other end of said window, a third heating element generally defines a first central heatable zone generally adjacent to and inboard of said second heatable zone and a fourth heating element generally defines a second central heating zone positioned between said first and third heatable zones, and further wherein said lower but bar of said first heating element is connected to said lower bus bar of said second heating element, said upper bus bar of said second heating element is connected to said upper bus bar of said third heating element and said lower bus bar of said third heating element is connected to said lower bus bar of said fourth heating element, and a first electrical connecting means connected to said upper bus bar of said first heating element and a second electrical connecting means connected to said upper bus bar of said fourth heating element generally in close proximity to said first connecting means, said resistive filaments of said heating elements being configured to provide a heating system geometry for said heated window which produces more rapid heating in said third and fourth heating elements than in said first and second heating elements.

2. An electrically heated window of claim 1, wherein said electrical resistance heating elements are applied to an interior surface of a window of a vehicle.

3. An electrically heated window of claim 1, wherein said electrical resistance heating elements are applied to a plastic interlayer of a laminated window of a vehicle.

4. An electrically heated window of claim 1, wherein said electrically conducting resistive filaments of said electrical resistance heating elements defining said third and fourth heatable zones are less in number than the number of the electrically conducting resistive filaments of the other of said electrical resistance heating elements.

5. An electrically heated window of claim 1, wherein said electrically conducting resistive filaments of said electrical resistance heating elements defining said third and fourth heatable zones are reduced in cross-sectional area as compared to the cross-sectional area of the electrically conducting resistive filaments of the other of said electrical resistance heating elements.

6. An electrically heated window of claim 1, wherein the length of said electrically conducting resistive filaments of said electrical resistance heating elements defining said third and fourth heatable zones are shorter in length than the length of the electrically conducting resistive filaments of the other of said electrical resistance heating elements.

7. An electrically heated window of claim 1, wherein all of said bus bars are positioned generally horizontally on said window.

8. An electrically heated window of claim 7, wherein said lower bus bar for each of said first and second electrical resistance heating elements is a single, common lower bus bar which traverses substantially the entire length of said window and electrically interconnects said first and second heating elements.

9. An electrically heated window of claim 8, wherein said lower bus bar of each of said third and fourth electrical resistance heating elements is a single, common lower bus bar electrically interconnecting said third and fourth heating elements which is positioned on said window above said common lower bus bar connecting said first and second electrical resistance heating elements and generally parallel thereto.

10. An electrically heated window of claim 9, wherein said upper bus bar of said second electrical resistance heating element is connected to said upper bus bar of said third electrical resistance heating element by an electrical coupling means.

11. An electrically heated window of claim 10, wherein said electrical coupling means is a braided jumper connected between said upper bus bars of said second and third electrical resistance heating elements.

12. An electrically heated window of claim 9, wherein said upper bus bars of said first, second, third and fourth electrical resistance heating elements are all positioned generally horizontally and in-line on said window.

13. An electrically heated window of claim 9, wherein said upper bus bar of each of said second and third electrical resistance heating elements is a single, common upper bus bar electrically interconnecting said second and third heating elements.

* * * * *

UNITED STATES PATENT AND TRADEMARK OFFICE

CERTIFICATE OF CORRECTION

PATENT NO. : 5,182,431

DATED : January 26, 1993

INVENTOR(S) : Harry S. Koontz and John P. Forr

It is certified that error appears in the above-identified patent and that said Letters Patent are hereby corrected as shown below:

Claim 1, column 6, line 41, delete the word "but" and insert --bus--.

Signed and Sealed this

Seventh Day of October, 1997

*Attest:*

Bruce Lehman

BRUCE LEHMAN

*Attesting Officer*

*Commissioner of Patents and Trademarks*